US005990622A

United States Patent [19]

Schult et al.

[11] Patent Number: 5,990,622

[45] Date of Patent: Nov. 23, 1999

[54] GRID SUPPORT STRUCTURE FOR AN ELECTRON BEAM DEVICE

[75] Inventors: Holger Schult, Montoursville; John Charles Cipolla, Trout Run, both of Pa.

[73] Assignee: Litton Systems, Inc., Woodland Hills, Calif.

[21] Appl. No.: 09/017,369

[22] Filed: Feb. 2, 1998

[51] Int. Cl.[6] ..... H01J 29/46

[52] U.S. Cl. ..... 315/5.37; 313/257; 313/447

[58] Field of Search ..... 315/5.33, 5.37; 313/451, 456, 255, 257, 447

[56] References Cited

U.S. PATENT DOCUMENTS

| | | | |
|---|---|---|---|
| 2,325,865 | 8/1943 | Litton | 315/5.38 |
| 2,886,733 | 5/1959 | Naill | 313/265 |
| 3,805,106 | 4/1974 | Hooker | 313/456 |
| 4,480,210 | 10/1984 | Preist et al. | 315/4 |
| 4,527,091 | 7/1985 | Preist | 315/5 |
| 4,611,149 | 9/1986 | Nelson | 315/5.39 |
| 4,728,852 | 3/1988 | Hoet | 313/348 |
| 4,737,680 | 4/1988 | True et al. | 313/349 |
| 4,975,617 | 12/1990 | Van Gorkum et al. | 313/348 |
| 5,233,269 | 8/1993 | Lien | 315/5.37 |
| 5,317,233 | 5/1994 | Lien et al. | 315/5.37 |
| 5,536,992 | 7/1996 | Crompton | 315/4 X |
| 5,572,092 | 11/1996 | Shrader | 315/5.37 |
| 5,581,153 | 12/1996 | Bridges | 315/5 |
| 5,629,582 | 5/1997 | Dobbs | 313/456 |

FOREIGN PATENT DOCUMENTS

| | | |
|---|---|---|
| 1 357 469 | 6/1974 | United Kingdom . |
| 2 287 579 | 9/1995 | United Kingdom . |

OTHER PUBLICATIONS

"Bonded Grid Electron Gun For 95 GHz Extended Interaction Amplifier (EIA)", by T.J. Grant et al., 1983 IEEE, IEDM 83, pp. 141–143.

*Primary Examiner*—Justin P. Bettendorf
*Attorney, Agent, or Firm*—O'Melveny & Myers LLP

[57] ABSTRACT

A grid support structure is provided for a linear beam device having an axially centered cathode, an anode spaced therefrom and a grid disposed between the cathode and anode. The grid support structure maintains a proper grid-to-cathode spacing across an operating temperature range of the linear beam device. The grid is comprised of pyrolytic graphite, and includes a central active portion and a peripheral portion, with the peripheral portion comprising a plurality of evenly spaced elongated mounting holes. The grid support structure includes an inner grid support and an outer grid support. The inner grid support may include a plurality of axially extending posts that engage the mounting holes of the grid. The grid may further include resilient tabs that engage corresponding ramped surfaces to bias the grid into position.

22 Claims, 9 Drawing Sheets

GRID SUPPORT STRUCTURE FOR AN ELECTRON BEAM DEVICE

BACKGROUND OF THE INVENTION

1. Field of the Invention

The present invention relates to linear beam amplification devices having an electron emitting cathode and an RF modulated grid closely spaced therefrom, and more particularly, to a novel support structure for the grid that accommodates thermal expansion while maintaining an optimum grid-to-cathode spacing.

2. Description of Related Art

It is well known in the art to utilize a linear beam device, such as a klystron or travelling wave tube amplifier, to generate or amplify a high frequency RF signal. Such devices generally include an electron emitting cathode and an anode spaced therefrom. The anode includes a central aperture, and by applying a high voltage potential between the cathode and anode, electrons may be drawn from the cathode surface and directed into a high power beam that passes through the anode aperture. One class of linear beam device, referred to as an inductive output tube (IOT), further includes a grid disposed in the inter-electrode region defined between the cathode and anode. The electron beam may thus be density modulated by applying an RF signal to the grid relative to the cathode. As the density modulated beam propagates across a gap provided downstream within the IOT, RF fields are induced into a cavity coupled to the gap. The RF fields may then be extracted from the cavity in the form of a high power, modulated RF signal. An example of an IOT is provided by U.S. Pat. No. 5,650,751, to R. S. Symons, for INDUCTIVE OUTPUT TUBE WITH MULTISTAGE DEPRESSED COLLECTOR ELECTRODES, the subject matter of which is incorporated in the entirety by reference herein.

Since it is desirable to space the grid closely to the cathode surface, it thus must be capable of withstanding very high operating temperatures. In view of these demanding operating conditions, it is known to use pyrolytic graphite material for the grid due to its high dimensional stability and heat resistance. The pyrolytic graphite grid may be made very thin, with a pattern of openings formed therein, such as by conventional laser trimming techniques, to permit passage of the electron beam therethrough. The low coefficient of expansion of the pyrolytic graphite permits the grid to be heated by direct thermal radiation from the cathode and by dissipation of RF drive power when applied between the cathode and grid, without expanding the grid into the cathode and shorting these two elements together. As a result, the grid may be positioned very close to the cathode surface, permitting low RF drive voltage and high gain.

Nevertheless, a practical limitation on the efficiency of such linear beam devices has been the difficulty of supporting the grid in a proper position relative to the cathode surface. A metallic grid support structure, such as comprised of copper or stainless steel, will thermally expand at a much greater rate than the pyrolytic graphite grid, causing the relatively delicate grid to rupture. It is known to dispose a resilient, annular contact element between the grid and the metal grid support structure, such as a metallic braid, that compresses upon thermal expansion of the grid support structure to maintain proper spacing between the grid and the cathode surface. A drawback of this construction is that the resiliency of the contact element tends to degrade over time, especially due to the repeated thermal cycling of the device. Moreover, the addition of the contact element increases the complexity and associated cost of manufacture of the device.

Thus, it would be very desirable to provide a grid support structure for a linear beam device that maintains a proper spacing between the cathode and grid across the operating temperature range of the device. It would be further desirable to provide such a grid support structure which avoids the use of an additional resilient member.

SUMMARY OF THE INVENTION

In accordance with the teachings of the present invention, a grid support structure is provided for a linear beam device having an axially-centered, concave cathode and an anode spaced therefrom. The grid support structure maintains a proper grid-to-cathode spacing across an operating temperature range of the linear beam device.

More particularly, the grid is operable to accept a high frequency control signal to density modulate an electron beam emitted by the cathode. The grid comprises a central active portion and a peripheral portion, with the peripheral portion comprising a plurality of evenly spaced elongated mounting holes. The grid is comprised of pyrolytic graphite material having a stress relieved composition of at least 5–10 nucleation sites per 0.010 inch thickness. The peripheral portion of the grid may further comprise an annular flange. The cathode comprises a concave electron emitting surface, and the active portion of the grid comprises a concave shape that corresponds with the emitting surface.

In a first embodiment of the invention, the grid support structure comprises an inner grid support disposed adjacent to and outwardly of the cathode, and an outer grid support disposed axially between the inner grid support and the anode. The inner grid support comprises a plurality of axially directed posts substantially aligned to the mounting holes of the peripheral portion of the grid, permitting the grid to be coupled to the inner grid support with the posts engaging respective ones of the mounting holes. The outer grid support is further adapted for coupling to the inner grid support. The outer grid support further comprises an annular channel aligned with the posts, so that an axial space is defined between an end of the posts and a bottom of the channel when the outer grid support is coupled to the inner grid support. The grid is maintained in alignment with the cathode by a ring disposed within the annular channel. The ring has a plurality of axial alignment holes aligned to the posts, and is compressed between the flange and the bottom of the annular channel with the outer grid support coupled to the inner grid support.

In a second embodiment of the invention, the grid support structure comprises an inner grid support and an outer grid support similar to that of the first embodiment. The grid flange is coupled to the inner grid support by forming a braze joint therebetween.

In a third embodiment of the invention, the grid support structure comprises an inner grid support and an outer grid support similar to that of the first embodiment. The inner grid support comprises a plurality of axially directed posts substantially aligned to the mounting holes of the peripheral portion of the grid, permitting the grid to be aligned to the inner grid support. The outer grid support further comprises an annular channel aligned with the posts, so that an axial space is defined between an end of the posts and a bottom of the channel when the outer grid support is coupled to the inner grid support. The grid is maintained in alignment with the cathode by a ring disposed within the annular channel. The ring has a plurality of axial alignment holes aligned to the posts. The flange further comprises a plurality of resilient tabs alternating with the mounting holes, with the ring further having a plurality of ramped surfaces aligned to the resilient tabs. The resilient tabs press against the ramped surfaces with the outer grid support coupled to the inner grid support. The resilient tabs are defined within an outer periphery of the flange by axial slots defined in the flange. The inner grid support may further comprise a stepped region aligned to the resilient tabs to provide a flexing space for the resilient tabs.

In a fourth embodiment of the invention, the grid support structure comprises an inner grid support and an outer grid support similar to that of the first embodiment. The inner grid support comprises a plurality of axially directed posts substantially aligned to the mounting holes of the peripheral portion of the grid, permitting the grid to be aligned to the inner grid support. The outer grid support further comprises an annular channel aligned with the posts, so that an axial space is defined between an end of the posts and a bottom of the channel when the outer grid support is coupled to the inner grid support. The grid is maintained in alignment with the cathode by a ring disposed within the annular channel. The ring has a plurality of axial alignment holes aligned to the posts. The flange further comprises a plurality of resilient tabs alternating with the mounting holes, with the ring further having a plurality of ramped surfaces aligned to the resilient tabs. The resilient tabs press against the ramped surfaces with the outer grid support coupled to the inner grid support. The resilient tabs extend outwardly of an outer periphery of the flange. The inner grid support may further comprise a stepped region aligned to the resilient tabs to provide a flexing space for the resilient tabs.

In a fifth embodiment of the invention, the grid support structure comprises an inner grid support and an outer grid support similar to that of the first embodiment. The inner grid support comprises a plurality of axially directed posts substantially aligned to the mounting holes of the peripheral portion of the grid, permitting the grid to be aligned to the inner grid support. The outer grid support further comprises an annular channel aligned with the posts, so that an axial space is defined between an end of the posts and a bottom of the channel when the outer grid support is coupled to the inner grid support. The grid is maintained in alignment with the cathode by a ring disposed within the annular channel. The ring has a plurality of axial alignment holes aligned to the posts. A washer is compressed between the ring and the bottom of said annular channel with the outer grid support coupled to the inner grid support.

In a sixth embodiment of the invention, the grid support structure comprises an inner grid support and an outer grid support similar to that of the first embodiment. The peripheral portion of the grid further comprises a flexible, U-shaped expansion joint that is brazed at an end thereof to an innermost radial edge of the inner grid support.

In a seventh embodiment of the invention, the peripheral portion of the grid follows the concave shape of the active portion of the grid. The grid support structure comprises an inner grid support and an outer grid support each having respective surfaces corresponding to the concave shape of the grid. The inner grid support further comprises a plurality of axially directed posts substantially aligned to the mounting holes of the peripheral portion of the grid, permitting the grid to be aligned to the inner grid support. The peripheral portion of the grid further comprises a plurality of resilient tabs alternating with the mounting holes, with the outer grid support further having a plurality of ramped surfaces aligned to the resilient tabs. The resilient tabs press against the ramped surfaces with the outer grid support coupled to the inner grid support.

In an eighth embodiment of the invention, the grid support structure comprises an inner grid support and an outer grid support similar having annular surfaces without axial posts. The outer grid support further comprises an annular channel, with a ring disposed in the channel. The grid is maintained in alignment with the cathode by compression between by the ring and the annular surface of the inner grid support.

In a ninth embodiment of the invention, the grid support structure comprises an inner grid support and an outer grid support similar to that of the first embodiment. The inner grid support comprises a plurality of axially directed posts substantially aligned to the mounting holes of the peripheral portion of the grid, permitting the grid to be aligned to the inner grid support. The outer grid support further comprises an annular channel aligned with the posts, so that an axial space is defined between an end of the posts and a bottom of the channel when the outer grid support is coupled to the inner grid support. The grid is maintained in alignment with the cathode by a rim that extends from the outer grid support to define a side surface of the annular channel. The rim has a tip that extends to and presses against the flange with the outer grid support coupled to the inner grid support.

A more complete understanding of the grid support structure for a linear beam device will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a grid support structure for a linear beam device that maintains a proper spacing between the cathode and grid across the operating temperature range of the device, and which avoids the use of an additional resilient member. In the detailed description that follows, it should be appreciated that like element numerals are used to describe like elements illustrated in one or more of the figures.

Figure 2:
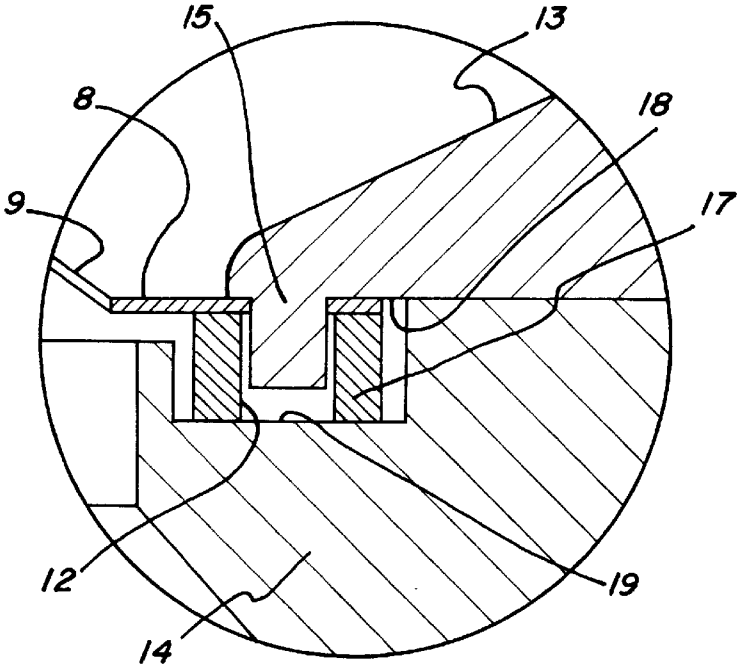
FIG. 2 is an enlarged view of the grid support structure illustrated in FIG. 1.
Figure 3:
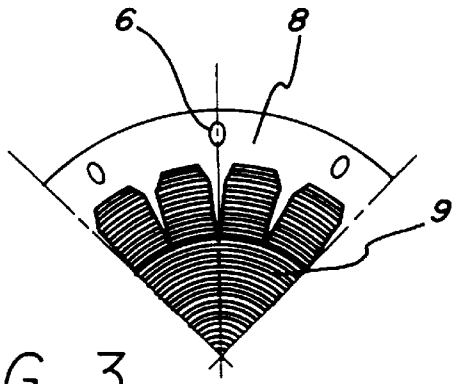
FIG. 3 is an enlarged view of a portion of the grid used in the grid support structure of FIG. 1.
Figure 1:
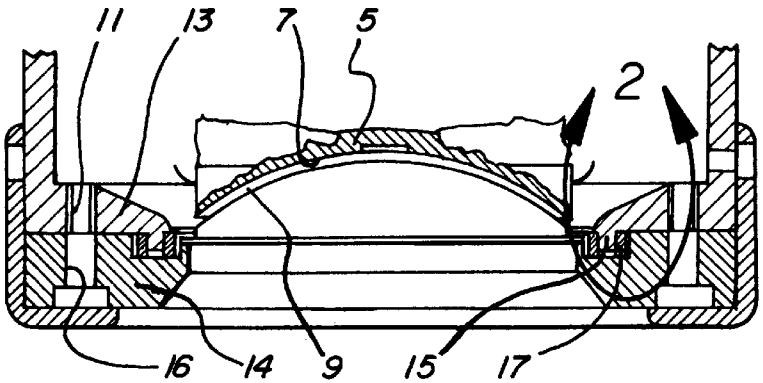
FIG. 1 is a side sectional view of a first embodiment of a grid support structure of the present invention.

A first embodiment of a grid support structure in accordance with the present invention is illustrated in FIGS. 1–3, in which a linear beam device includes an axially centered grid 9 disposed in close proximity to a cathode 5. The cathode 5 has a concave electron emitting surface 7 with a radius of curvature equivalent to that of the grid 9 so that the grid and emitting surface are generally parallel to each other. The grid 9 is secured in place by a grid support structure (described below). The grid 9 has a flange 8 disposed at an outward peripheral edge thereof. The grid flange 8 is flat and lies in a plane that is substantially normal to the axis of the electron beam emitted by the cathode 5. A plurality of evenly-spaced elongated mounting holes 6 are disposed along the flange 8. Preferably, the grid 9 is comprised of pyrolytic graphite material having a stress relieved composition of at least 5–10 nucleation sites per 0.010 inch thickness. This ensures that the grid will have sufficient flexibility to withstand the stress of thermal expansion of the grid support structure.

The grid support structure includes an inner grid support 13, an outer grid support 14, and an annular compression ring 17. The inner grid support 13 has a plurality of axially directed posts 15 that are aligned with the elongated holes 6 of the flange 8, and which are used to align the grid 9 to the cathode 5. The inner grid support 13 has a plurality of threaded bolt holes 11 and the outer grid support 14 has corresponding bolt holes 16 that permit the structures to be fastened together by a plurality of bolts. Each of the inner and outer grid supports 13, 14 have annular surfaces that come into contact with each other with the grid supports bolted together. The outer grid support 14 provides a focusing electrode for the linear beam device, and may be comprised of stainless steel which is known to increase the breakdown voltage.

An annular channel 19 is disposed in the annular surface of the outer grid support 14. The compression ring 17 is disposed in the annular channel 19 between the grid flange 8 and the outer grid support 14. The compression ring 17 also has a plurality of evenly-spaced holes 12 aligned with the elongated holes 6 of the flange 8 and the posts 15 of the inner grid support 13. The outer peripheral edge of the grid flange 8 terminates within the space defined by the channel 19 and does not extend to the region between the joined annular surfaces of the inner and outer grid supports 13, 14. In addition, a space is defined between the bottom surface of the post 15 and the bottom of the channel 19.

It is anticipated that the inner grid support member 13 be comprised of copper, with the compression ring 17 comprised of a slightly softer alloy of copper. Tightening of the bolts holding the inner grid support 13 to the outer grid support 14 compresses the compression ring 17 so that it conforms to the grid flange 8 in order to account for any tolerance irregularities of the grid support structure. During high temperature "bake-out" of the linear beam device, the compression ring 17 softens to reduce internal stress within the compression ring. As a result, a very slight axial gap forms between the compression ring 17 and the grid flange 8 (not shown), which permits the grid to slide freely between the compression ring and upper grid support 13 during operation of the device.

During operation of the linear beam device, the pyrolytic graphite material of the grid 9 will experience little thermal expansion. The inner and outer grid supports 13, 14, on the other hand, will exhibit some thermal expansion in both the axial and radial directions. The material composition of the inner grid support 13, outer grid support 14 and compression ring 17 may be selected to have similar coefficients of expansion, and thus will expand and contract at a uniform rate. As these elements expand in the radial direction, the grid flange 8 will move between the inner grid support 13 and the compression ring 17 within the track defined by the elongated holes 6 of the grid flange. Thermal expansion in the axial direction may change the spacing between the grid and the cathode surface, however, the cathode is also expected to experience thermal expansion which may tend to keep the grid-to-cathode spacing roughly constant. Accordingly, this variation in axial spacing of the grid support structure is acceptable.

Figure 5:
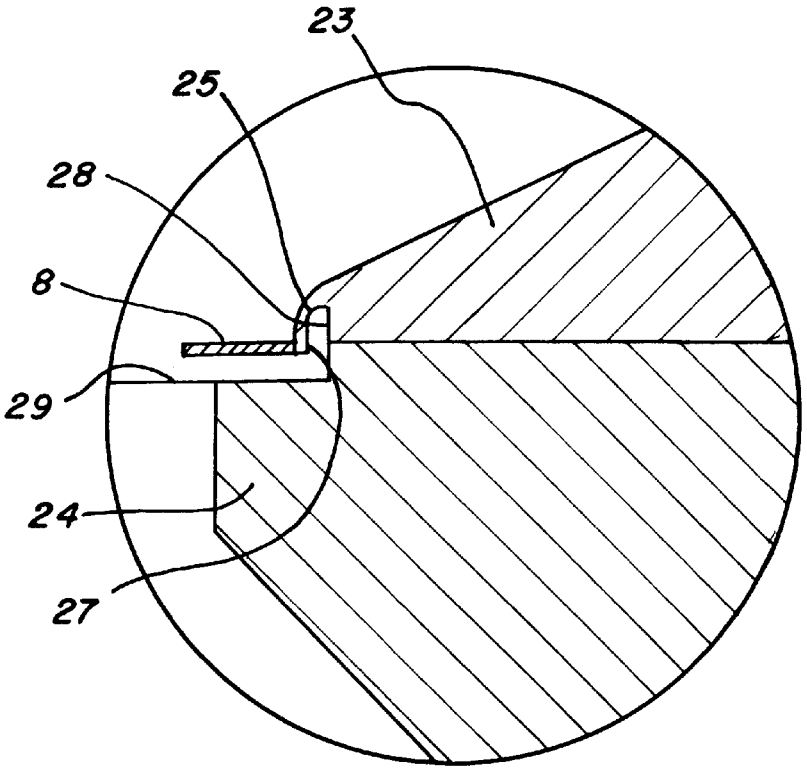
FIG. 5 is an enlarged view of the grid support structure illustrated in FIG. 4.
Figure 4:
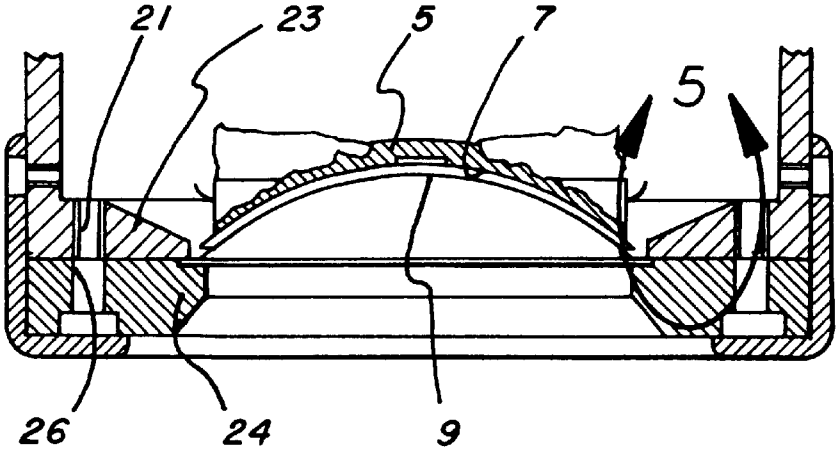
FIG. 4 is a side sectional view of a second embodiment of a grid support structure of the present invention.

Referring now to FIGS. 4–5, a second embodiment of a grid support structure is illustrated. The grid 9 has a peripheral flange 8 without any mounting holes. The grid support structure of the second embodiment includes an inner grid support 23 and an outer grid support 24. The inner grid support 23 has a plurality of threaded bolt holes 21 and the outer grid support 24 has corresponding bolt holes 26 that permit the structures to be fastened together by a plurality of bolts. As in the preceding embodiment, the inner and outer grid supports 23, 24 each have annular surfaces that come into contact with each other with the grid supports bolted together. The outer grid support 24 provides a focusing electrode for the linear beam device.

A step 29 is disposed in the annular surface of the outer grid support 24. The inner grid support 23 has an axially extending rim 25 at an innermost radial point thereof. A gap is defined between the rim 25 radially outward to an axial surface of the inner grid support 23. The outermost edge of the grid flange 8 is brazed to the tip 27 of the rim 25. The outer grid support 24 does not come into contact with the grid, and there is no other intermediary structure between the grid flange 8 and the outer grid support. As described above, thermal expansion of the grid support structure in the axial direction is considered acceptable. Thermal expansion of the inner grid support 23 in the radial direction may be accommodated by movement of the rim 25 into the aforementioned gap.

Figure 7:
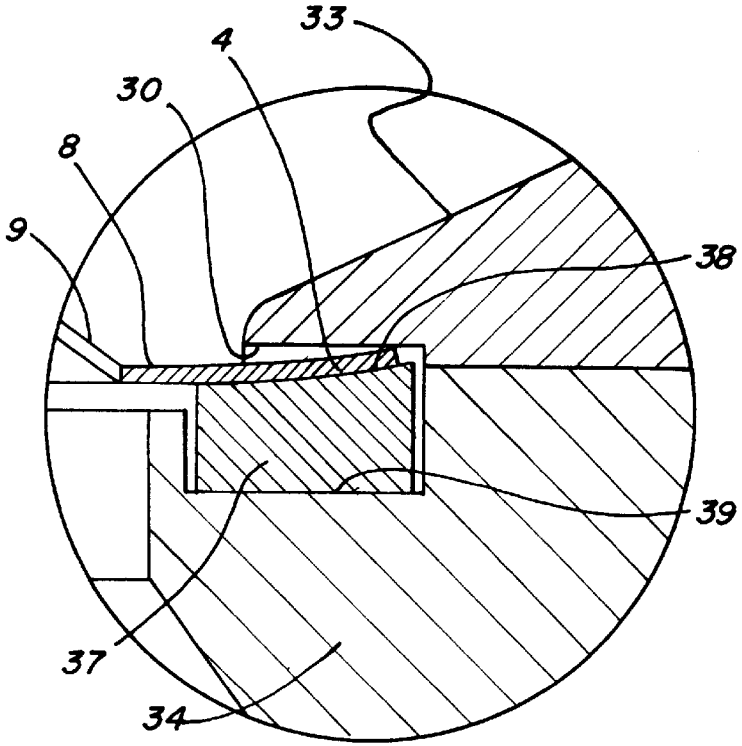
FIG. 7 is an enlarged view of the grid support structure illustrated in FIG. 6.
Figure 8:
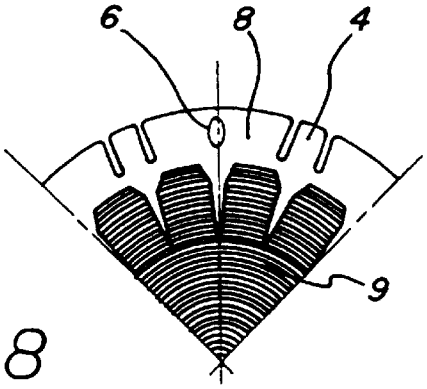
FIG. 8 is an enlarged view of a flange portion of the grid used in the grid support structure of FIG. 6.
Figure 6:
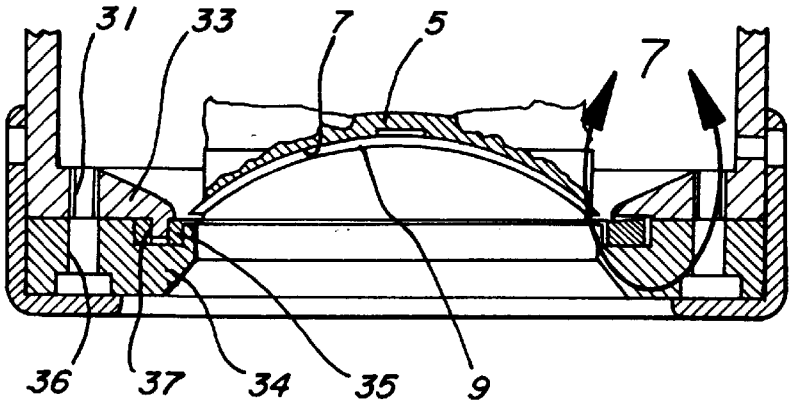
FIG. 6 is a side sectional view of a third embodiment of a grid support structure of the present invention.

A third embodiment of a grid support structure is illustrated in FIGS. 6–8. The grid 9 has a peripheral flange 8 having a plurality of evenly-spaced mounting holes 6 that are disposed in an alternating manner with tabs 4. The tabs 4 are formed by cutting radially extending slots from the outer periphery of the flange 8 inward through the flange. The tabs 4 have a resilience due to the flexibility of the pyrolytic graphite material of the grid 9.

The grid support structure of the third embodiment includes an inner grid support 33, an outer grid support 34, and a rigid contact ring 37. As in the preceding embodiments, the inner grid support 33 has a plurality of threaded bolt holes 31 and the outer grid support 34 has corresponding bolt holes 36 that permit the structures to be fastened together by a plurality of bolts. The inner and outer grid supports 33, 34 each have annular surfaces that come into contact with each other with the grid supports bolted together. The outer grid support 34 provides a focusing electrode for the linear beam device.

The inner grid support 33 has a plurality of axially directed posts 35 that are aligned with the holes 6 of the flange 8. The contact ring 37 is similar in shape to the compression ring 17 of the first embodiment and has a plurality of evenly-spaced holes that are aligned with the holes of the flange 8. The contact ring 37 also has a plurality of ramped surfaces 38 that are aligned with the resilient tabs 4 of the grid flange 8 and which alternate with the evenly-spaced holes. The contact ring 37 is disposed between the outer grid support 34 and the grid flange 8 in an annular channel 39 of the outer grid support. The grid flange 8 is not compressed between the contact ring 37 and the inner grid support 33. Instead, the inner grid support 33 has a step region 30 that defines a space between the inner grid support and the resilient tabs 4 which allows the grid to slide along the track defined by the elongated mounting holes 6 of the grid flange 8.

The flexing of the resilient tabs 4 against the ramped surfaces 38 provides sufficient tension to hold the grid 9 in place. Thermal expansion of the grid support structure in the radial direction is facilitated by movement of the posts 35 within the elongated holes 6 of the flange 8 and by movement of the resilient tabs 4 along the ramped surfaces 38. As in the preceding embodiments, thermal expansion of the grid support structure in the axial direction is acceptable. In addition, electrical contact between the grid support structure and the grid flange 8 is maintained by the pressure of the resilient tabs 4 against the ramped surfaces 38.

Figure 10:
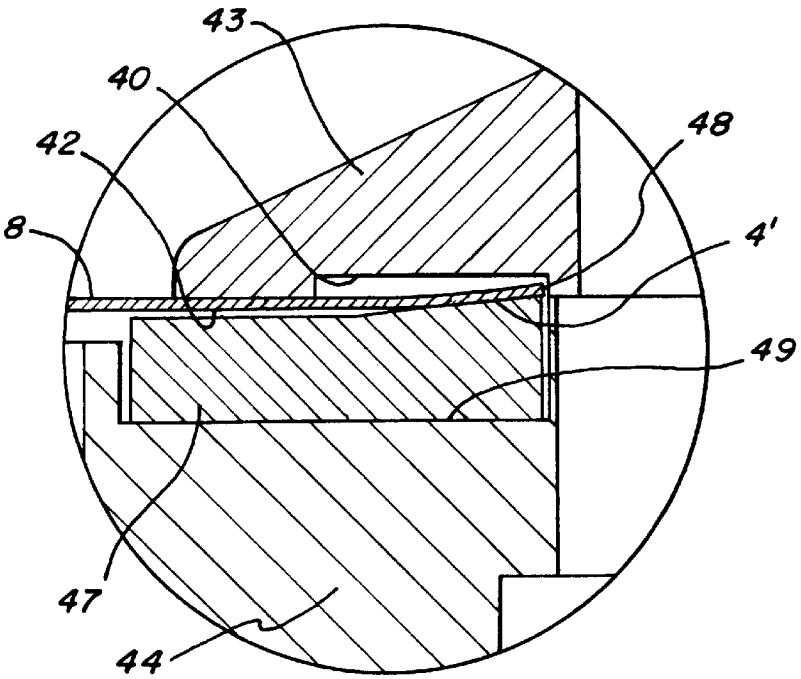
FIG. 10 is an enlarged view of the grid support structure illustrated in FIG. 9.
Figure 11:
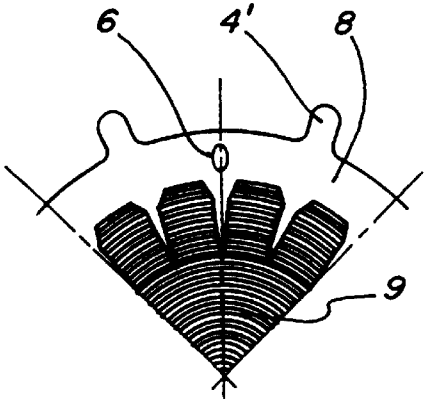
FIG. 11 is an enlarged view of a flange portion of the grid used in the grid support structure of FIG. 9.
Figure 9:
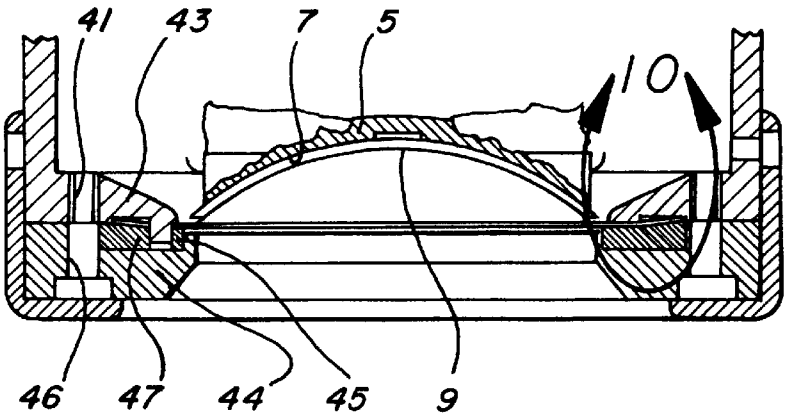
FIG. 9 is a side sectional view of a fourth embodiment of a grid support structure of the present invention.

A fourth embodiment of a grid support structure is illustrated in FIGS. 9–11. The grid 9 has a peripheral flange 8 having a plurality of evenly-spaced mounting holes 6 that are disposed in an alternating manner with tabs 4'. Unlike the tabs 4 of the preceding embodiment, the tabs 4' extend outwardly from the outer periphery of the flange 8. As in the preceding embodiment, the tabs 4' have a resilience due to the flexibility of the pyrolytic graphite material of the grid 9.

The grid support structure of the fourth embodiment includes an inner grid support 43, an outer grid support 44, and a rigid contact ring 47. As in the preceding embodiments, the inner grid support 43 has a plurality of threaded bolt holes 41 and the outer grid support 44 has corresponding bolt holes 46 that permit the structures to be fastened together by a plurality of bolts. The inner and outer grid supports 43, 44 each have annular surfaces that come into contact with each other with the grid supports bolted together. The outer grid support 44 provides a focusing electrode for the linear beam device.

The inner grid support 43 has a plurality of axially directed posts 45 that are aligned with the holes 6 of the flange 8. The contact ring 47 is similar in shape to the contact ring 37 of the preceding embodiment and has a plurality of evenly-spaced holes that are aligned with the holes of the flange 8. The contact ring 37 also has a plurality of ramped surfaces 48 that are aligned with the resilient tabs 4' of the grid flange 8 and which alternate with the evenly-spaced holes. The contact ring 47 is disposed between the outer grid support 44 and the grid flange 8 in an annular channel 49 of the outer grid support. The grid flange 8 is not compressed between the contact ring 47 and the inner grid support 43. Instead, the inner grid support 43 has a step region 40 that defines a space between the inner grid support and the resilient tabs 4' which allows the grid to slide along the track defined by the elongated mounting holes 6 of the grid flange 8. The step region 40 is disposed radially outward from an annular surface 42 of the inner grid support 43, which is in contact with the grid flange 8 due to pressure exerted by the flexing of the tabs 4' against the ramped surfaces 48.

The flexing of the resilient tabs 4' against the ramped surfaces 48 provides sufficient tension to hold the grid 9 in place. It should be appreciated that by extending the resilient tabs 4' outwardly of the flange 8 periphery, any distortion of the grid 9 due to the bending of the resilient tabs is minimized. Thermal expansion of the grid support structure in the radial direction is facilitated by movement of the posts 45 within the elongated holes 6 of the flange 8 and by movement of the resilient tabs 4' along the ramped surfaces 48. As in the preceding embodiments, thermal expansion of the grid support structure in the axial direction is acceptable. In addition, electrical contact between the grid support structure and the grid flange 8 is maintained by the pressure of the resilient tabs 4' against the ramped surfaces 48.

Figure 13:
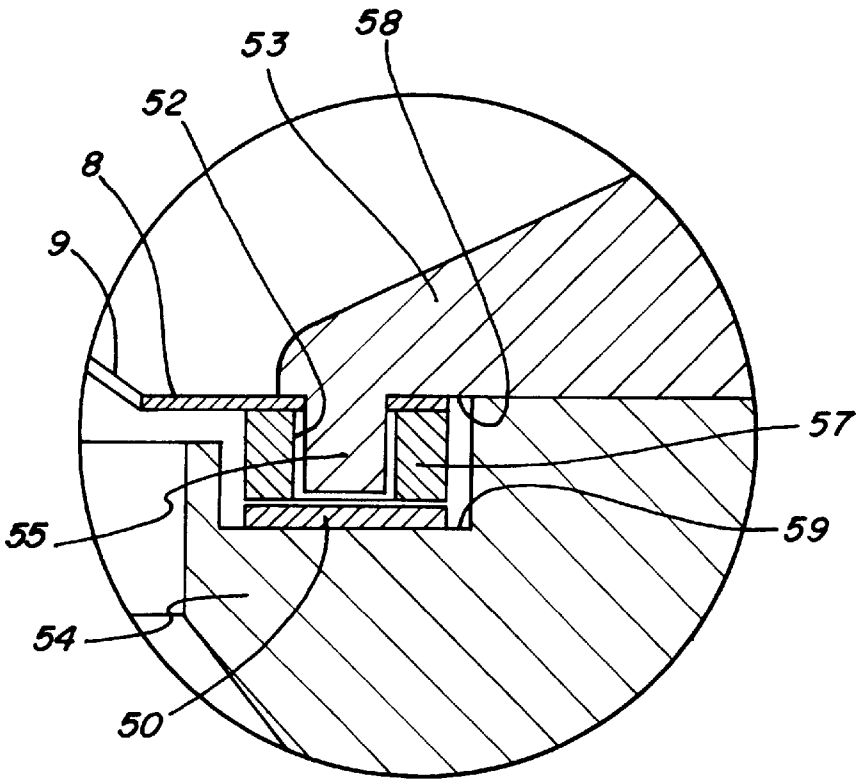
FIG. 13 is an enlarged view of the grid support structure illustrate d in FIG. 12.
Figure 12:
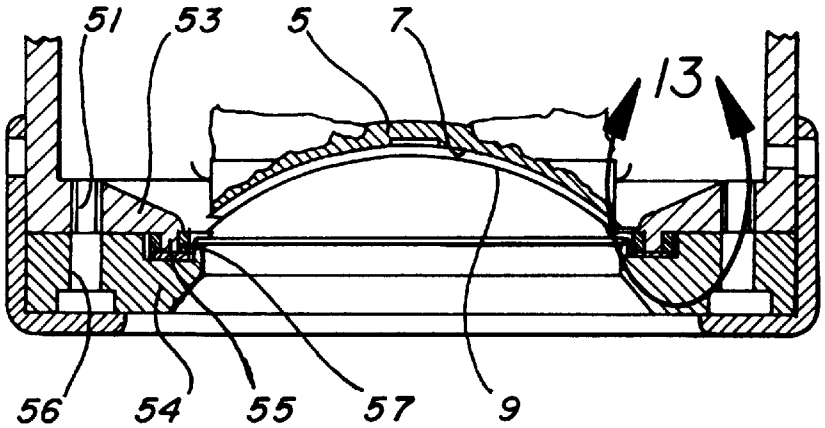
FIG. 12 is a side sectional view of a fifth embodiment of a grid support structure of the present invention.

A fifth embodiment of a grid support structure is illustrated in FIGS. 12–13. The grid 9 includes a flange 8 having a plurality of evenly-spaced elongated holes as shown in FIG. 3 described above. The grid support structure includes an inner grid support 53, an outer grid support 54, a ring 57, and a flat washer 50. The inner grid support 53 has a plurality of axially directed posts 55 that are aligned with the elongated holes of the flange 8, and which are used to align the grid 9 to the cathode 5. The inner grid support 53 has a plurality of threaded bolt holes 51 and the outer grid support 54 has corresponding bolt holes 56 that permit the structures to be fastened together by a plurality of bolts. Each of the inner and outer grid supports 53, 54 have annular surfaces that come into contact with each other with the grid supports bolted together. The outer grid support 54 provides a focusing electrode for the linear beam device.

An annular channel 59 is disposed in the annular surface of the outer grid support 54. The ring 57 and washer 50 are disposed in the annular channel 59 between the grid flange 8 and the outer grid support 54, with the washer lying against the bottom of the channel 59. The ring 57 also has a plurality of evenly-spaced holes 52 aligned with the elongated holes of the flange 8 and the posts 55 of the inner grid support 53. The outer peripheral edge of the grid flange 8 terminates within the space defined by the channel 59 and does not extend to the region between the joined annular surfaces of the inner and outer grid supports 53, 54. In addition, a space is defined between the bottom surface of the post 55 and the washer 50.

It is anticipated that the ring 57 be comprised of stainless steel, and the washer 50 be comprised of copper. The washer 50 accounts for the slight differences in tolerances of the ring 57, inner grid support 53 and outer grid support 54, and compresses upon tightening of the bolts holding the inner and outer grid supports together. As in the first embodiment, a slight gap forms between the grid flange 8 and the ring 57 following "bake-out" which permits movement of the grid relative to the grid supports and the ring. As the grid support structure expands in the radial direction, the grid flange 8 will move between the inner grid support 53 and the ring 57 within the track defined by the elongated holes of the grid flange. Thermal expansion in the axial direction is considered acceptable.

Figure 15:
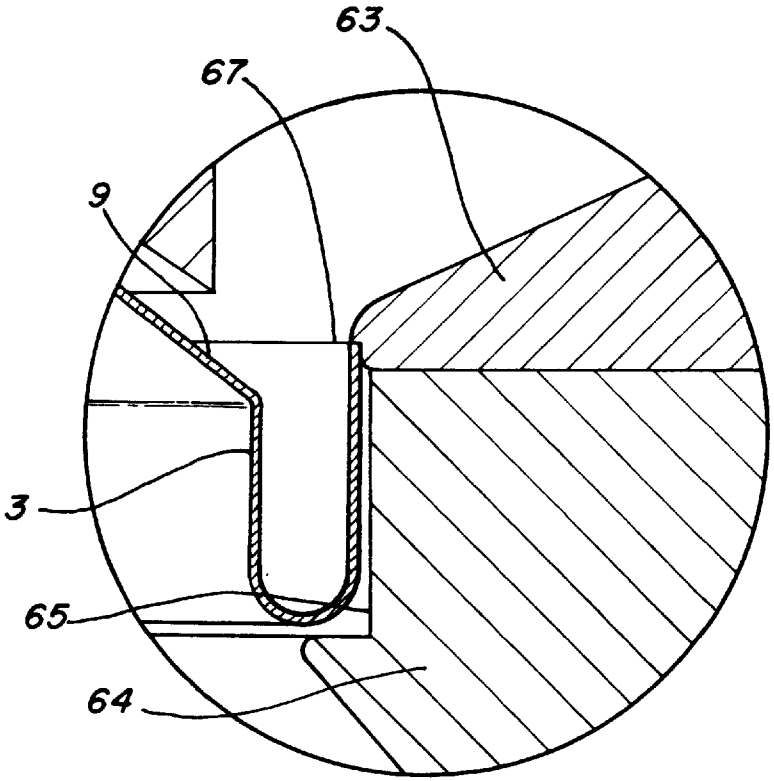
FIG. 15 is an enlarged view of the grid support structure illustrated in FIG. 14.
Figure 14:
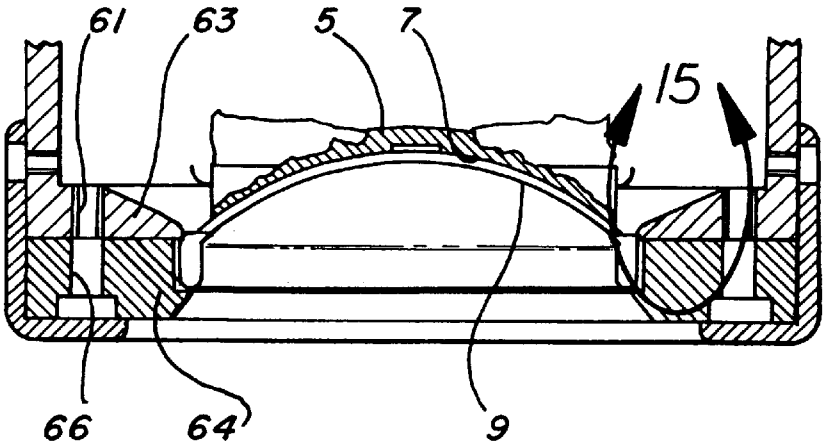
FIG. 14 is a side sectional view of a sixth embodiment of a grid support structure of the present invention.

A sixth embodiment of a grid support structure is illustrated in FIGS. 14–15. Unlike the previous embodiments, the grid 9 includes a resilient expansion joint 3 that holds the grid in the proper position relative to the cathode emitting surface. Specifically, the expansion joint 3 comprises a U-shaped extension from the peripheral edge of the grid 9, and is integrally formed with the grid of the pyrolytic graphite material. The grid 9 of the sixth embodiment lacks an annular flange as in the previous embodiments.

The grid support structure of the sixth embodiment includes an inner grid support 63 and an outer grid support 64. The inner grid support 63 has a plurality of threaded bolt holes 61 and the outer grid support 64 has corresponding bolt holes 66 that permit the structures to be fastened together by a plurality of bolts. Each of the inner and outer grid supports 63, 64 have annular surfaces that come into contact with each other with the grid supports bolted together. The outer grid support 64 provides a focusing electrode for the linear beam device. The peripheral edge of the expansion joint 3 is brazed to the inner grid support 63 at a radially inward edge 67 of the inner grid support. The curved portion of the expansion joint 3 provides a flex point to accommodate thermal expansion of the grid support structure in the radial direction. Notably, no part of the expansion joint 3 is disposed between the inner and outer grid supports 63, 64 as in the preceding designs.

Figure 17:
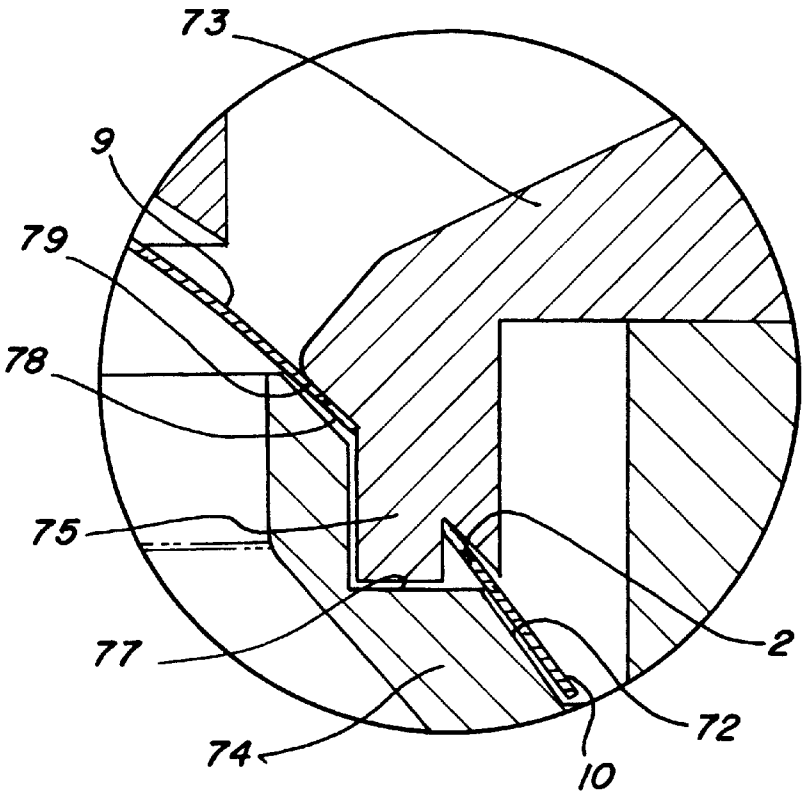
FIG. 17 is an enlarged view of the grid support structure illustrated in FIG. 16.
Figure 16:
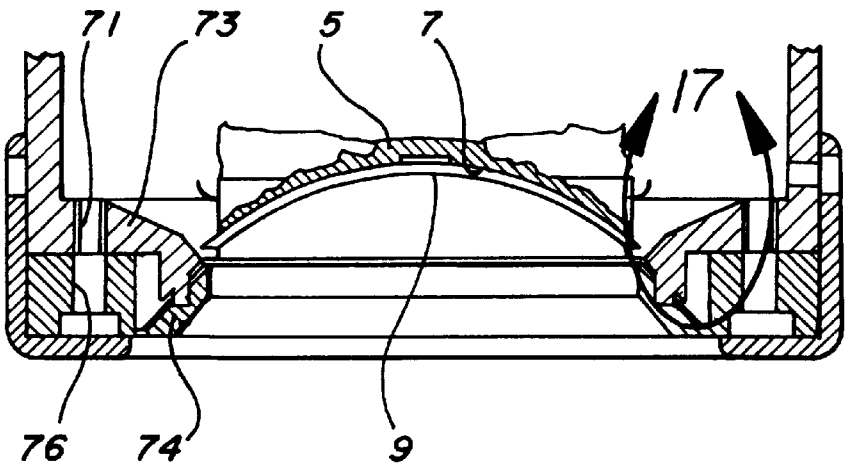
FIG. 16 is a side sectional view of a seventh embodiment of a grid support structure of the present invention.

A seventh embodiment of a grid support structure is illustrated in FIGS. 16–17. Unlike the first five embodiments, the grid 9 of the seventh embodiment does not have a flange. Instead, the peripheral portion of the grid 9 follows the same concave shape as the grid and has a plurality of spaced elongated holes 2 provided through the peripheral portion of the grid. The grid 9 further includes resilient tabs 10 defined in the peripheral edge by radial slots extending inward from the periphery thereof, similar to the tabs 4 of FIG. 8.

The grid support structure of the seventh embodiment includes an inner grid support 73 and an outer grid support 74. The inner grid support 73 has a plurality of threaded bolt holes 71 and the outer grid support 74 has corresponding bolt holes 76 that permit the structures to be fastened together by a plurality of bolts. The outer grid support 74 provides a focusing electrode for the linear beam device. Each of the inner and outer grid supports 73, 74 have curved facing surfaces that match the curvature of the grid 9. The inner grid support 73 has a plurality of axially directed posts 75 that are aligned with the elongated holes of the grid 9, and which are used to align the grid to the cathode 5. The outer grid support 74 also has a plurality of ramped surfaces 72 which coincide with slotted tabs 10, as in the third embodiment described above. The grid 9 is moveable between the inner and outer grid supports 73, 74, and the outer grid support acts as a spherical bearing against which the resilient tabs 10 provide force to maintain the grid in contact therewith to accommodate thermal expansion of the grid support structure in the radial direction. The grid 9 further presses against surface 79 of the inner grid support 73 disposed radially inward from the posts 75, allowing a slight gap to form between the grid and the corresponding surface 78 of the outer grid support 74.

Figure 19:
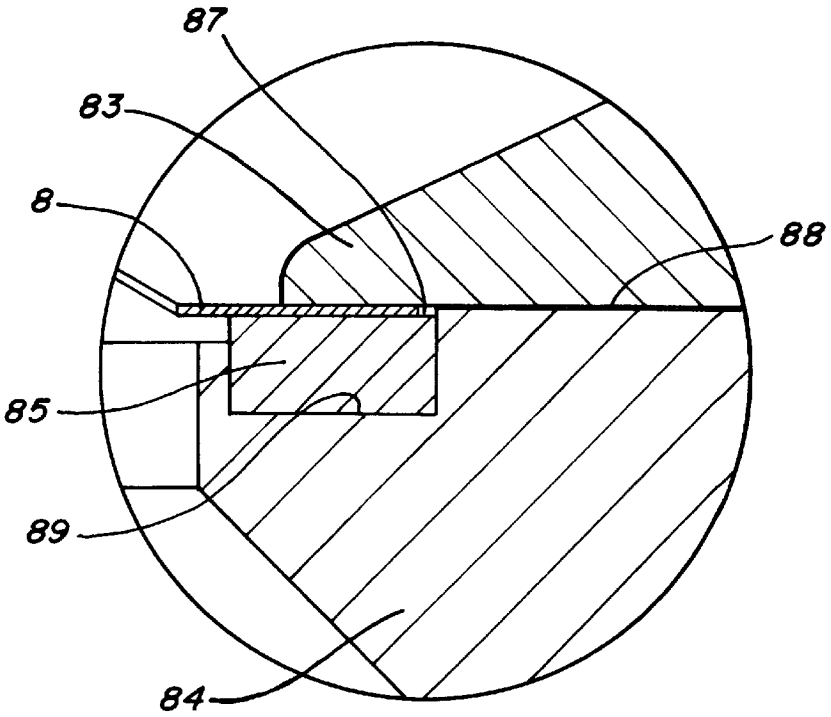
FIG. 19 is an enlarged view of the grid support structure illustrated in FIG. 18.
Figure 18:
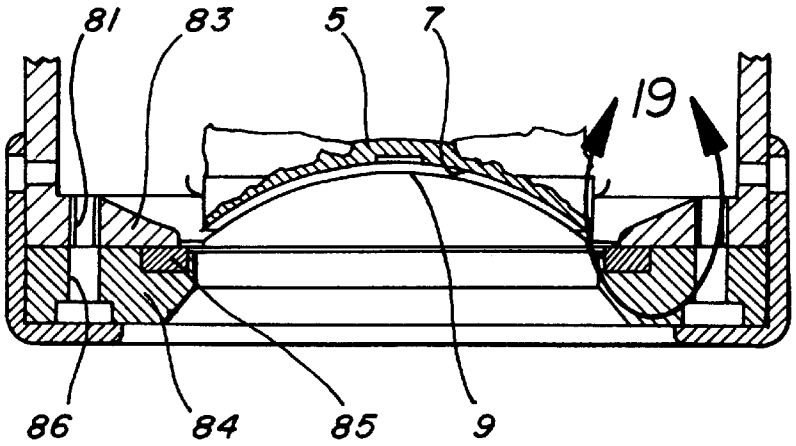
FIG. 18 is a side sectional view of an eighth embodiment of a grid support structure of the present invention.

An eighth embodiment of a grid support structure is illustrated in FIGS. 18–19. The grid 9 has a peripheral flange 8 without any mounting holes. The grid support structure of the eighth embodiment includes an inner grid support 83, an outer grid support 84, and a ring 85. The inner grid support 83 has a plurality of threaded bolt holes 81 and the outer grid support 84 has corresponding bolt holes 86 that permit the structures to be fastened together by a plurality of bolts. As in the preceding embodiment, the inner and outer grid supports 83, 84 each have annular surfaces 88 that come into contact with each other with the grid supports bolted together. The outer grid support 84 provides a focusing electrode for the linear beam device.

An annular channel 89 is disposed in the annular surface of the outer grid support 84. The ring 85 is brazed in the annular channel 89. The ring 85 has a height that is slightly below that of the annular surfaces at which the inner and outer grid supports 83, 84 are joined, defining a space 87 equal to, or slightly less than, the thickness of the grid flange 8. The grid flange 8 is compressed between the ring 85 and the inner grid support 83, and is rigidly held in position. As described above, thermal expansion of the grid support structure in the axial direction is considered acceptable. While thermal expansion of the inner grid support 23 in the radial direction may introduce forces on the grid 9, the flexibility of the grid is sufficient to absorb these forces with minimal distortion to the grid. Moreover, by avoiding any movement of the grid flange 8 relative to the grid support structure, a solid electrical connection between these elements is maintained.

Figure 20:
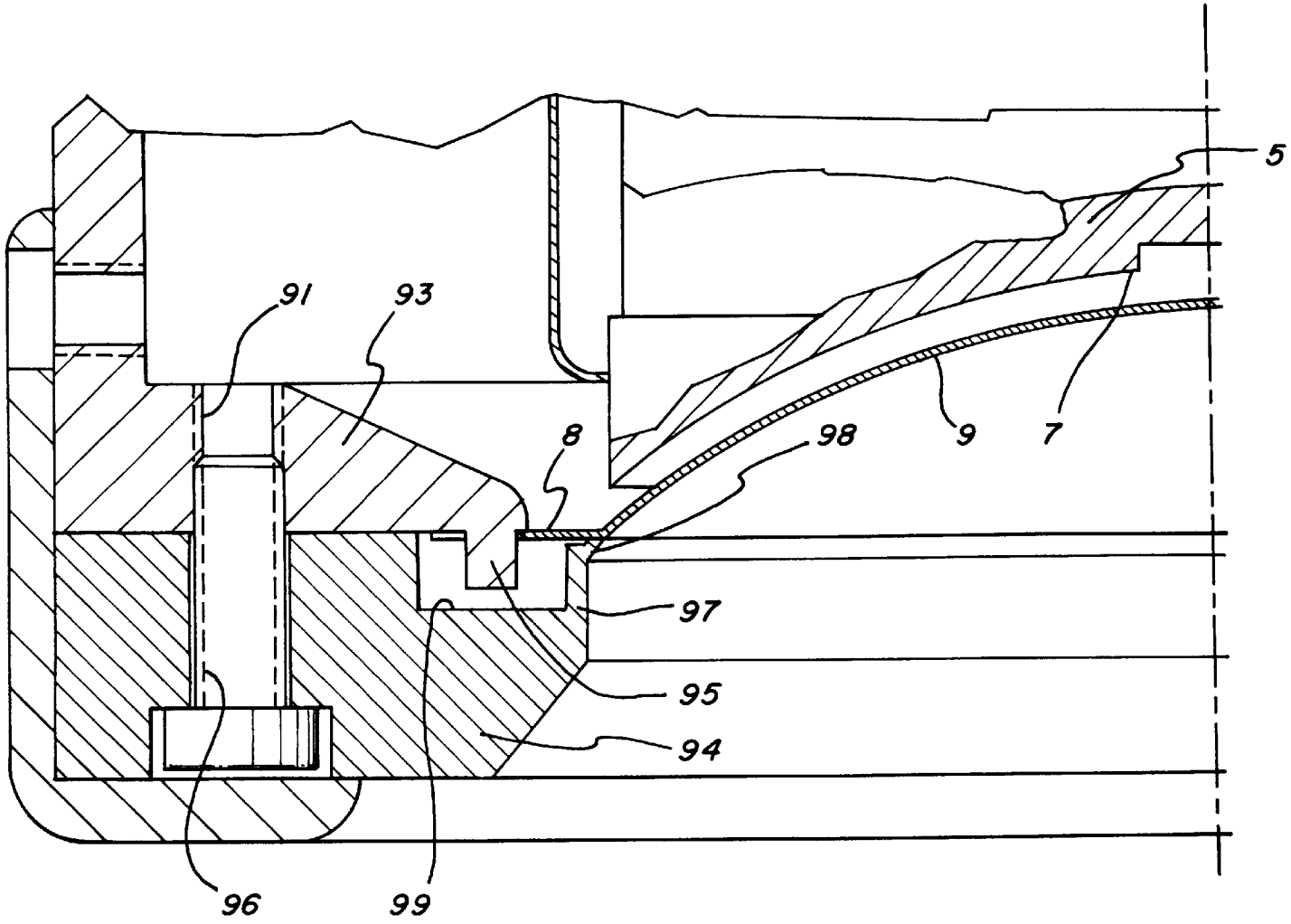
FIG. 20 is a side sectional view of a ninth embodiment of a grid support structure of the present invention.

A ninth embodiment of the grid support structure is illustrated in FIG. 20. As in the first embodiment, the grid 9 has a peripheral flange 8 having a plurality of evenly-spaced mounting holes. The grid support structure of the ninth embodiment includes an inner grid support 93 and an outer grid support 94. The inner grid support 93 has a plurality of threaded bolt holes 91 and the outer grid support 94 has corresponding bolt holes 96 that permit the structures to be fastened together by a plurality of bolts. As in the preceding embodiment, the inner and outer grid supports 93, 94 each have annular surfaces that come into contact with each other with the grid supports bolted together. The outer grid support 94 provides a focusing electrode for the linear beam device.

The inner grid support 93 has a plurality of axially directed posts 95 that are aligned with the holes of the grid flange 8. An annular channel 99 is disposed in the annular surface of the outer grid support 94. The posts 95 of the inner grid support 93 extend into the annular channel 99 with a space defined between the end of each post and the bottom of the channel. The outer grid support 94 further includes a rim 97 disposed at a radially inward portion thereof. The rim 97 extends in an axial direction defining and enclosing wall of the channel 99. An uppermost tip 98 of the rim comes into contact with the grid flange 8. Pressure applied by the tip 98 against the flange 8 presses the flange against the inner grid support 93. As described above, thermal expansion of the grid support structure in the axial direction is considered acceptable. While thermal expansion of the inner grid support 93 in the radial direction may introduce forces on the grid 9, the flexibility of the grid is sufficient to absorb these forces with minimal distortion to the grid.

Having thus described a preferred embodiment of a grid support structure for a linear beam device, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A linear beam device having an axially centered cathode and an anode spaced therefrom, said anode and cathode being operable to form and accelerate an electron beam, said device comprising:

an axially centered grid disposed between said cathode and anode, said grid being operable to accept a high frequency control signal to density modulate said beam, said grid comprising a central active portion and a peripheral portion, said peripheral portion comprising a plurality of evenly spaced elongated mounting holes;

a first grid support disposed adjacent to and outwardly of said cathode, said first grid support comprising a plurality of axially directed posts substantially aligned to said mounting holes of said peripheral portion of said grid, said grid being adapted for coupling to said first grid support with said posts engaging respective ones of said mounting holes;

a second grid support disposed axially between said first grid support and said anode, said second grid support being adapted for coupling to said first grid support; and means for maintaining said grid in an aligned position relative to said cathode, said maintaining means further comprising a contact portion of said second grid support disposed radially inward from said first grid support, said contact portion being in contact with and pressing against said peripheral portion of said grid, wherein flexure of said grid against pressure applied by said contact portion maintains said grid in said aligned position.

2. The linear beam device of claim 1, wherein said peripheral portion of said grid further comprises an annular flange.

3. The linear beam device of claim 1, wherein said second grid support further comprises an annular channel aligned with said posts, an axial space being defined between an end of said posts and a bottom of said channel with said second grid support coupled to said first grid support.

4. The linear beam device of claim 1, wherein said maintaining means further comprises a rim extending from said second grid support and defining a side surface of said annular channel, said rim providing said contact portion.

5. The linear beam device of claim 1, wherein said grid is comprised of pyrolytic graphite material having a stress relieved composition of at least 5–10 nucleation sites per 0.010 inch thickness.

6. The linear beam device of claim 1, wherein said cathode comprises a concave emitting surface, and said active portion of said grid comprises a concave shape in correspondence with said emitting surface.

7. The linear beam device of claim 1, wherein said first grid support is comprised of copper.

8. The linear beam device of claim 1, wherein said second grid support is comprised of stainless steel.

9. A linear beam device having an axially centered cathode and an anode spaced therefrom, said anode and cathode being operable to form and accelerate an electron beam, said device comprising:

an axially centered grid disposed between said cathode and anode, said grid being operable to accept a high frequency control signal to density modulate said beam, said grid comprising a central active portion and a peripheral portion, said peripheral portion comprising a plurality of evenly spaced elongated mounting holes, and wherein said peripheral portion of said grid further comprises an annular flange;

an inner grid support disposed adjacent to and outwardly of said cathode, said inner grid support comprising a plurality of axially directed posts substantially aligned to said mounting holes of said peripheral portion of said grid, said grid being adapted for coupling to said inner grid support with said posts engaging respective ones of said mounting holes;

an outer grid support disposed axially between said inner grid support and said anode, said outer grid support being adapted for coupling to said inner grid support, and wherein said outer grid support further comprises an annular channel aligned with said posts, an axial space being defined between an end of said posts and a bottom of said channel with said outer grid support coupled to said inner grid support; and means for maintaining said grid in an aligned position relative to said cathode, wherein said maintaining means further comprises a ring disposed within said annular channel and a washer disposed between said ring and said bottom of said channel, said ring having a plurality of axial alignment holes aligned to said posts, said washer being compressed between said ring and said bottom of said annular channel with said outer grid support coupled to said inner grid support.

10. A linear beam device having an axially centered cathode and an anode spaced therefrom, said anode and cathode being operable to form and accelerate an electron beam, said device comprising:

an axially centered grid disposed between said cathode and anode, said grid being operable to accept a high frequency control signal to density modulate said beam, said grid comprising a central active portion and a peripheral portion, said peripheral portion comprising a plurality of evenly spaced elongated mounting holes;

a first grid support disposed adjacent to and outwardly of said cathode, said first grid support comprising a plurality of axially directed posts substantially aligned to said mounting holes of said peripheral portion of said grid, said grid being adapted for coupling to said first grid support with said posts engaging respective ones of said mounting holes;

a second grid support disposed axially between said first grid support and said anode, said second grid support being adapted for coupling to said first grid support, said second grid support further comprising an annular channel aligned with said posts, an axial space being defined between an end of said posts and a bottom of said channel with said second grid support coupled to said first grid support; and means for maintaining said grid in an aligned position relative to said cathode, wherein said maintaining means further comprises a ring disposed within said annular channel and having a plurality of axial alignment holes aligned to said posts, said ring being in contact with said peripheral portion of said grid while permitting movement of said peripheral portion between said ring and said first grid support.

11. The linear beam device of claim 10, wherein said grid is comprised of pyrolytic graphite material having a stress relieved composition of at least 5–10 nucleation sites per 0.010 inch thickness.

12. The linear beam device of claim 10, wherein said cathode comprises a concave emitting surface, and said active portion of said grid comprises a concave shape in correspondence with said emitting surface.

13. The linear beam device of claim 10, wherein said first grid support is comprised of copper.

14. The linear beam device of claim 10, wherein said second grid support is comprised of stainless steel.

15. A linear beam device having an axially centered cathode and an anode spaced therefrom, said anode and cathode being operable to form and accelerate an electron beam, said device comprising:

an axially centered grid disposed between said cathode and anode, said grid being operable to accept a control signal to modulate said beam, said grid comprising a central active portion and a peripheral portion;

a first grid support disposed adjacent to and outwardly of said cathode; and a second grid support disposed axially between said first grid support and said anode, said second grid support being adapted for coupling to said first grid support with said peripheral portion of said grid disposed therebetween, said second grid support further comprising a contact portion disposed radially inward from an innermost portion of said first grid support, said contact portion pressing against said peripheral portion of said grid, whereby flexure of said grid against pressure applied by said contact portion operates to maintain said grid in said aligned position.

16. The linear beam device of claim 15, wherein said peripheral portion of said grid further comprises a plurality of evenly spaced elongated mounting holes, said first grid support further comprising a plurality of axially directed posts substantially aligned to said mounting holes of said peripheral portion of said grid, said grid being adapted for coupling to said first grid support with said posts engaging respective ones of said mounting holes.

17. The linear beam device of claim 16, wherein said second grid support further comprises an annular channel aligned with said posts, an axial space being defined between an end of said posts and a bottom of said channel with said second grid support coupled to said first grid support.

18. The linear beam device of claim 17, wherein said second grid support further comprises a rim providing a side surface of said annular channel, an edge of said rim providing said contact portion.

19. The linear beam device of claim 15, wherein said grid is comprised of pyrolytic graphite material having a stress relieved composition of at least 5–10 nucleation sites per 0.010 inch thickness.

20. The linear beam device of claim 15, wherein said cathode comprises a concave emitting surface, and said active portion of said grid comprises a concave shape in correspondence with said emitting surface.

21. The linear beam device of claim 15, wherein said first grid support is comprised of copper.

22. The linear beam device of claim 15, wherein said second grid support is comprised of stainless steel.

* * * * *